US007150700B2

(12) United States Patent
MacKay et al.

(10) Patent No.: US 7,150,700 B2
(45) Date of Patent: Dec. 19, 2006

(54) ROTATING PUNCHING ACCESSORY

(76) Inventors: Kurt A. MacKay, 508 Nelson Ct., Northfield, MN (US) 55057; Anita M. MacKay, 508 Nelson Ct., Northfield, MN (US) 55057

( * ) Notice: Subject to any disclaimer, the term of this patent is extended or adjusted under 35 U.S.C. 154(b) by 0 days.

(21) Appl. No.: 09/892,753

(22) Filed: Jun. 28, 2001

(65) Prior Publication Data

US 2002/0013198 A1 Jan. 31, 2002

Related U.S. Application Data

(60) Provisional application No. 60/216,544, filed on Jul. 6, 2000.

(51) Int. Cl.
*A63B 21/00* (2006.01)

(52) U.S. Cl. ..... 482/83; 482/87

(58) Field of Classification Search ..... 482/105, 482/124, 83–90; 473/441
See application file for complete search history.

(56) References Cited

U.S. PATENT DOCUMENTS

| | | | | | |
|---|---|---|---|---|---|
| 2,696,383 | A | * | 12/1954 | Noftsinger | 473/441 |
| 3,390,880 | A | * | 7/1968 | Forrest | 473/441 |
| 4,345,755 | A | | 8/1982 | Eidson | 272/78 |
| 4,434,980 | A | | 3/1984 | Babineaux | 272/78 |
| 4,564,192 | A | | 1/1986 | Lebowitz | 272/76 |
| 4,593,900 | A | | 6/1986 | Burke | 272/76 |
| 4,593,901 | A | * | 6/1986 | Moore et al. | 482/83 |
| 5,046,724 | A | | 9/1991 | Sotomayer | 272/78 |
| 5,389,057 | A | | 2/1995 | Zagata, Jr. | 482/83 |
| 5,722,920 | A | | 3/1998 | Bauer | 482/83 |
| 5,899,835 | A | | 5/1999 | Puranda | 482/90 |
| 5,902,217 | A | * | 5/1999 | Schechner | 482/83 |

FOREIGN PATENT DOCUMENTS

| | | |
|---|---|---|
| GB | 600059 | 2/1946 |
| GB | 2243087 | 2/1990 |

* cited by examiner

*Primary Examiner*—Jerome Donnelly
(74) *Attorney, Agent, or Firm*—Patterson, Thuente, Skaar & Christensen, P.A.

(57) ABSTRACT

A rotating punching assembly used in combination with a variety of punching bag types. The first embodiment of the invention attaches the rotating punching bag assembly to the top of a standing type of punching bag using common nuts and bolts. The rotating punching assembly has cushioned punching pads that revolve around the standing punching bag when struck. The second embodiment is also attached to the top of a standing punching bag, but is attached with a hook and loop fastener arrangement. The third embodiment pertains to the use of the rotating punching assembly with a hanging punching bag, with the assembly being encircled around the hanging punching bag. All three embodiments are designed to revolve around a punching bag and to improve the speed and coordination of the user.

5 Claims, 5 Drawing Sheets

ROTATING PUNCHING ACCESSORY

CROSS-REFERENCE TO RELATED APPLICATION

This application claims the benefit of U.S. Provisional Patent Application Ser. No. 60/216,544, filed Jul. 6, 2000.

BACKGROUND OF THE INVENTION

1. Field of the Invention

The present invention relates to a rotating punching accessory that is used in combination with different types of heavy punching bags.

2. Description of Related Art

Martial arts and boxing are sports that are steeped in tradition and have increased in recent popularity with the physical fitness boom over the last twenty years. Both sports are very demanding both mentally and physically and require extensive training and dedication. The related art reflects the development of an extensive number of devices that can be used for the training of boxers and individuals participating in the martial arts.

U.S. Pat. No. 4,345,755 issued to Eidson outlines an exercise device where two hanging punching bags with swivel assemblies are attached to each end of an elongated member. An elastic cord is stretched between the hanger assemblies for each punching bag in order to dampen undesirable lateral movements of the punching bags from contact. A third swivel assembly is also provided between the two punching bags to balance the punching bags if one punching bag is heavier than the other.

U.S. Pat. No. 4,434,980 issued to Babineaux outlines a boxing device that responds to punches by swinging its own arms at its attacker. A pair of resilient boxing bags are tied together and are hung together by a rigid upper supporting structure. A pair of arms with boxing gloves that hang above the boxing bags and swing arcuately forward and upward are also provided to simulate a person fighting back.

U.S. Pat. No. 4,564,192 issued to Lebowitz outlines a training apparatus and method for training martial arts students. The apparatus has a pair of simulated limbs that are designed to strike blows against the student and require the student to defend himself. The blows are directed at the student with considerable force and at a variety of different angles and positions. A spring arrangement is also part of the apparatus and resiliently biases the limb members towards a neutral position relative to a student positioned in a striking area.

U.S. Pat. No. 5,389,057 issued to Zagata, Jr. outlines an exercise apparatus used for training boxers and martial arts students. The apparatus has an inflatable leather bag supported by the end of a padded, cantilevered arm, which is formed of a resilient material for absorbing energy from punches and kicks. The arm is attachable to a stand via an adjustment bracket which permits the height of the target to be varied in accordance with the user. There is also an optional handle accessory to allow a second person to manipulate the leather bag to increase the difficulty of the exercise for the first user.

U.S. Pat. No. 5,046,724 issued to Sotomayer outlines the use of a punching device that is spaced between two boxers, with each boxer striking the t-shaped device and responding in turn to the unpredictable movements from a variety of extension coil springs. The punching device is permanently connected to the floor and simulates moving in an unpredictable bobbing and weaving fashion for both participants. The device can also be used by a single boxer, in which case the device responds like a commonly available hanging punching bag.

U.S. Pat. No. 5,899,835 issued to Puranda outlines a device used by boxers, kick boxers and martial arts participants. The device has a base and a stanchion that is used in combination with a variety of attachments such as a body bag attachment, a punching bag striking unit, a t-bar unit and a spring immobilizer. The device is in a kit form for easy assembly and interchangability of the attachments.

All of the patents outline apparatuses that are useful in the training of boxers, martial artists and kick boxers. Most of these devices simulate another person or develop defense movements. However, none of these devices can improve an individual's speed, power and coordination. That is what is really needed, a device that improves an individual's speed, power and coordination for use in boxing, martial arts and kick boxing.

None of the above inventions and patents, taken either singly or in combination, is seen to describe the instant invention as claimed.

SUMMARY OF THE INVENTION

The invention is a rotating punching assembly used in combination with a variety of punching bag types. The first embodiment of the invention attaches the rotating punching bag assembly to the top of a standing type of punching bag using common nuts and bolts. The rotating punching assembly has cushioned punching pads that revolve around the standing punching bag when struck. The second embodiment is also attached to the top of a standing punching bag, but is attached with a hook and loop fastener arrangement. The third embodiment pertains to the use of the rotating punching assembly with a hanging punching bag, with the assembly being encircled around the hanging punching bag. All three embodiments are designed to revolve around a punching bag and to improve the speed and coordination of the user.

Accordingly, it is a principal object of the invention to provide a boxing or martial arts training device to improve the striking speed and coordination of the user.

It is another object of the invention to provide a device that could be used in combination with a punching bag.

It is a further object of the invention to provide a device that can be used with a variety of punching bag types.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
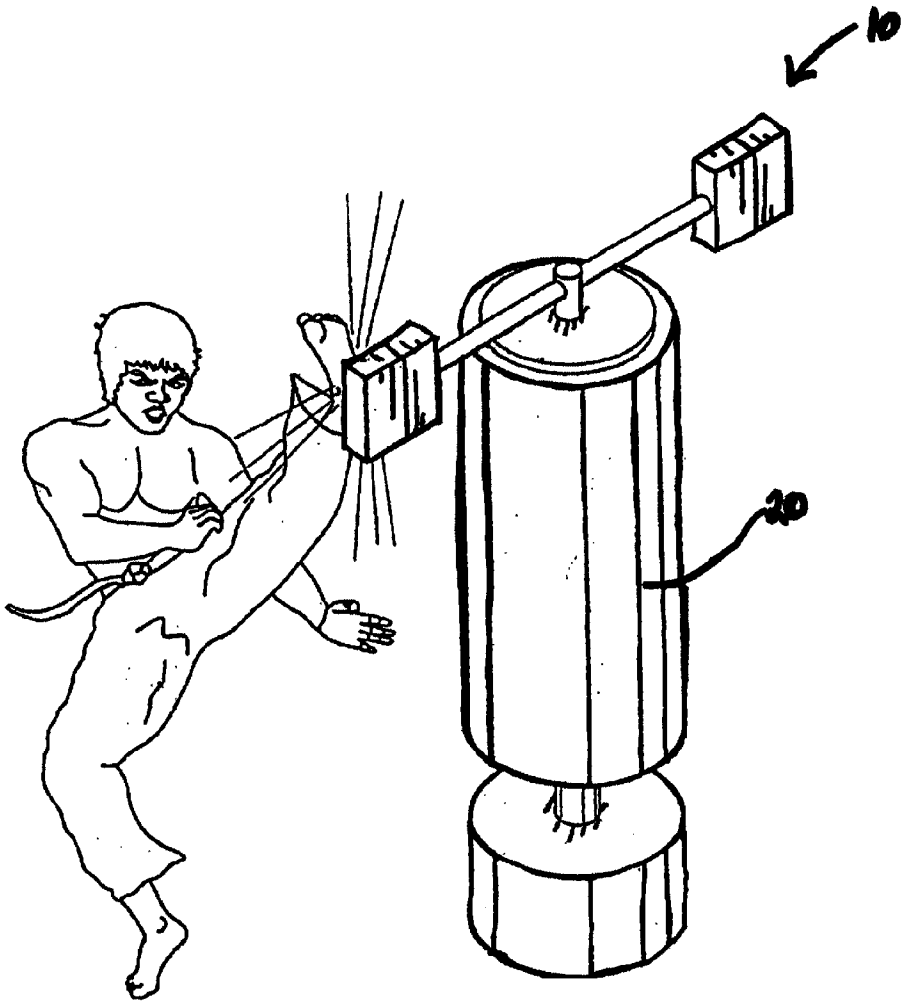
FIG. 1 is an environmental, perspective view of a rotating punching accessory according to the present invention.

The present invention is a rotating punching accessory 10, used in combination with a standing punching bag 20, which is depicted in FIG. 1.

Figure 2:
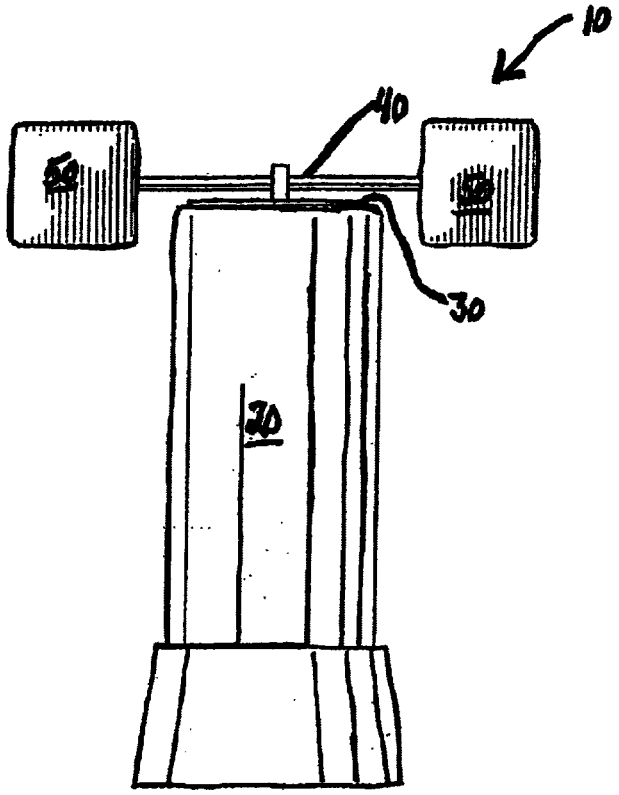
FIG. 2 is a front view of the first embodiment of a rotating punching accessory according to the present invention.
Figure 3:
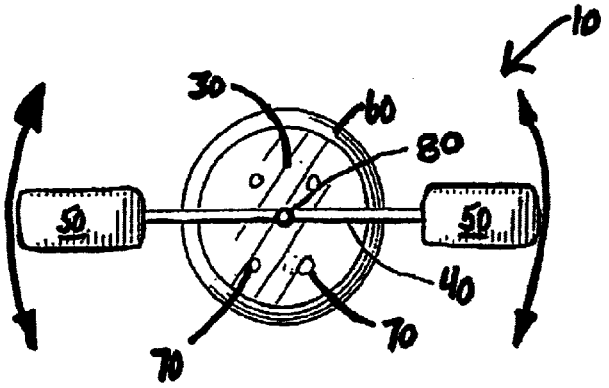
FIG. 3 is a top view of the first embodiment of a rotating punching accessory according to the present invention.

The first embodiment of the present invention comprises an attaching means for attaching a support plate 30 to the top 60 of the standing punching bag 20, a rectangular arm 40 with a rotating means for rotating the rectangular arm 40 in a clockwise and counterclockwise direction on top of the support plate 30 and a punching pad 50 that is located on each end of the rectangular arm 40. The punching pads 50 are well cushioned on the front and the back and can be struck in the front or on the back. Tubing is provided within the punching pads 50 for additional cushioning. These features are illustrated in FIG. 2.

The attaching means for attaching the support plate 30 to the top 60 of the rotating punching accessory 10 are nuts and bolts 70. This is a permanent attaching means that requires the use of common hand tools such as a wrench for installation. The nuts and bolts 70 permanently secure the entire rotating punching assembly 10 to the standing punching bag 20 while it is being used. The nuts and bolts 70 must be tightly secured in order for the rotating punching accessory 10 to be safely used.

The rotating punching accessory 10 also utilizes a rotating means for rotating the rectangular arm 40 in either a clockwise or counterclockwise rotation. This rotating means is a bearing and support axle 80 centered on top of the support plate 30. The bearing and support axle 80 is perpendicular to the support plate 30 and equidistant from each end of the rectangular arm 40. The bearing and support axle 80 is the pivot point for the rotation of the rotating punching accessory 10 and is mechanical technology that is well-known to those skilled in the art.

Figure 4:
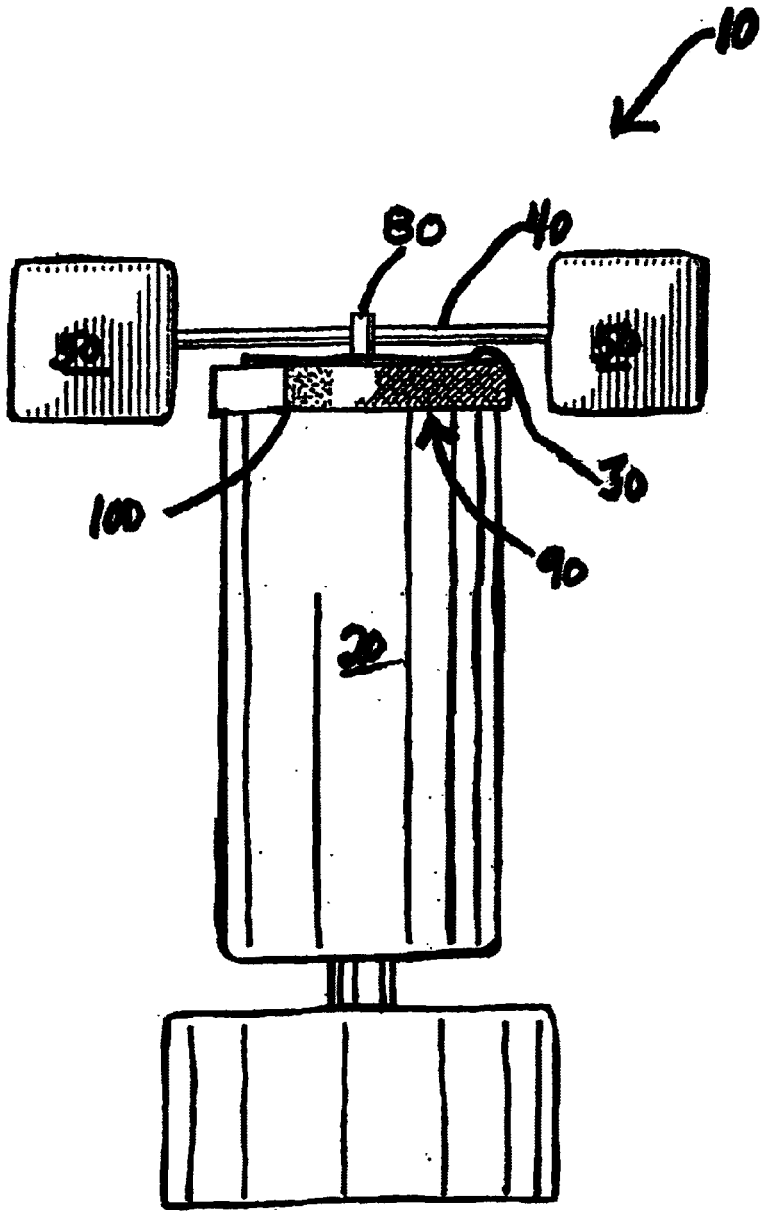
FIG. 4 is a front view of the second embodiment of a rotating punching accessory according to the present invention.

The second embodiment of the rotating punching assembly 10 also involves usage of a standing punching bag 20 and is depicted in FIG. 4. The second embodiment is comprised of an attaching means for attaching a support plate 30 to the top of the standing punching bag 60, a rectangular arm 40 with a rotating means for rotating the rectangular arm 40 in a clockwise and counterclockwise direction on top of the support plate 30 and a punching pad 50 that is located on each end of the rectangular arm 40.

The second embodiment has the same rotating means as she first embodiment, but has a different attaching means for attaching the support plate 30 to the top of a standing punching bag 20. The second embodiment utilizes a hook and loop fastener 90 situated on the edge of the standing punching bag 20. The standing punching bag is provided with a strip of the "loop" portion (not shown) of the hook and loop fastener 90 that is provided with an adhesive to secure the loop portion of the hook and loop fastener 90 near the edge of the standing punching bag 20.

This embodiment of the rotating punching assembly 10 is also provided with a flap 100 that is designed to fold over the loop portion of the hook and loop fastener 90. Inside the inner surface of the flap 100 is a strip of the "hooks" portion (not shown) of the hook and loop fastener 90. This hook and loop fastener 90 is designed to mate the strip of the loops portion with the hook portion of the hook and loop fastener 90. The hook and loop fastener technology is well-known to those schooled in the related art and is designed to temporarily secure the support plate 30 on top of the standing punching bay 60. The hook and loop fastener 90 is designed to be easily removed from the top of the standing punching bag 20 with a pulling separation between the hook portion and loop portion of the hook and loop fastener 90.

Figure 5:
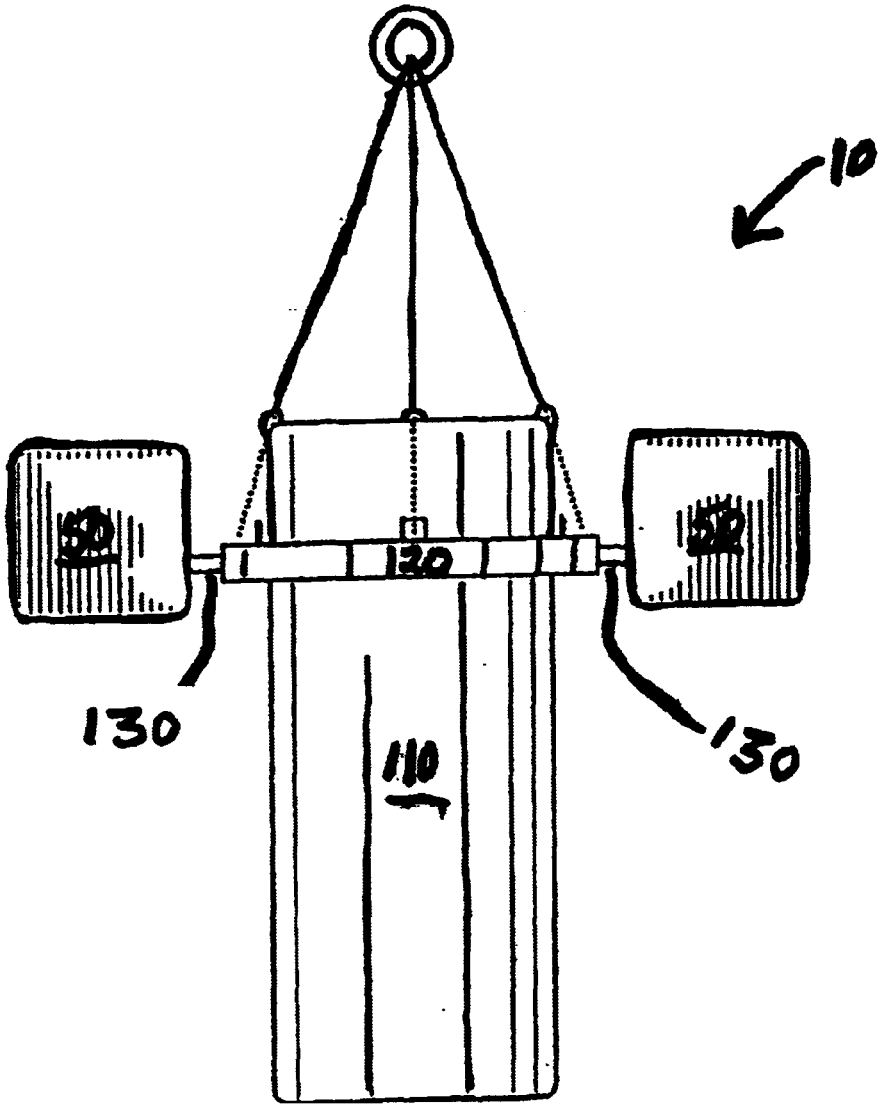
FIG. 5 is a front view of the third embodiment of a rotating punching accessory according to the present invention.
Figure 6:
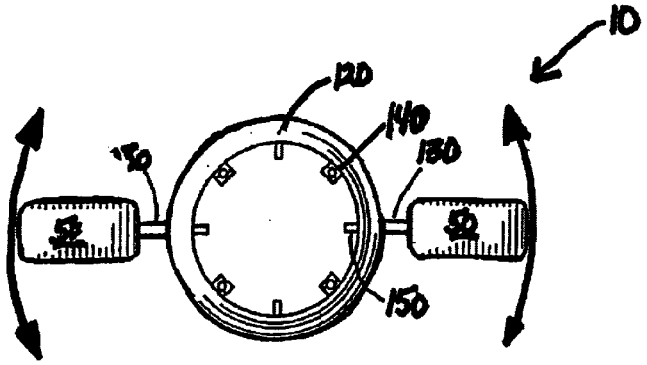
FIG. 6 is a top view of the third embodiment of a rotating punching accessory according to the present invention.

The third embodiment of the rotating punching assembly 10 is designed for use with a hanging type of punching bag 110. This third embodiment is depicted in FIG. 5 and is comprised of an attaching means for attaching a rotating ball bearing support plate 120 and rectangular arm 130 around the perimeter of the hanging punching bag 110. There is also a rotating means for rotating the rectangular arm 130 in a clockwise and counterclockwise direction around the hanging punching bag and a punching pad 50 that is located on each end of the rectangular arm 130.

This embodiment of the rotating punching assembly 10 utilizes the same punching pads 50 as the first two embodiments of the invention. However, the attaching means are hooks that are attached to hanging chains (not shown), that go through eyelets 140 provided on the rotating ball bearing support plate 120. The rotating means is also different than the first two embodiments and is a rotating ball bearing support plate 120 equidistant from each end of the rectangular arm 30 that is encircled around the hanging punching bag 110. There are also centering tabs 15C provided on the inside perimeter of the rotating ball bearing support plate 120 to keep the hanging punching bag 110 and the rotating punching assembly 10 centered.

Figure 7:
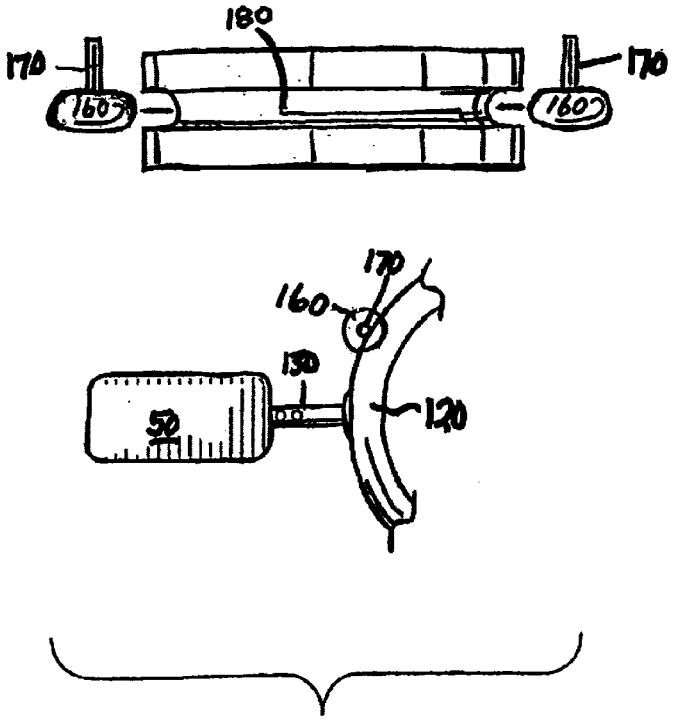
FIG. 7 is a front view of the ball bearing assembly used in the third embodiment of a rotating punching assembly.

FIG. 7 illustrates the components of the rotating ball bearing support plate 120. Rubber wheels 160 are set inside an outer groove 180 on the rotating ball bearing support plate 120 and the rotating rectangular arm 130 is attached to an axle 170 on the wheel 160. The rectangular arms 130 revolve around the rotating ball bearing support plate 120 while attached to the axles 170 on the wheels 160. This technology is not a novel feature of the invention and is well-known to those skilled in the art.

Operation of all three embodiments is uncomplicated. The first two embodiments are ready for use once the rotating punching assembly 10 is attached to the standing punching bag 20. The third embodiment is also uncomplicated and must be hung around the hanging type punching bag 110 before using in order to work properly.

It is to be understood that the present invention is not limited to the sole embodiments described above, but encompasses any and all embodiments within the scope of the following claims.

We claim:

1. A rotating punching accessory, used in combination with a standing punching bag, comprising:

a support plate;

a hook and loop fastener situated on the top side of the standing punching bag for attaching the support plate to the top of the punching bag;

a rectangular arm;

a rotating means for rotating the rectangular arm in a clockwise and counterclockwise direction on top of the support plate; and a punching pad that is located on each end of the rectangular arm.

2. A rotating punching accessory, used in combination with a hanging punching bag, comprising:

a rotating ball bearing support plate;

an attaching means for attaching the rotating ball bearing support plate to the hanging punching bag;

a rotating rectangular arm;

a rotating means for rotating the rectangular arm in a clockwise and counterclockwise direction on top of the support plate; and a punching pad that is located on each end of the rectangular arm.

3. The rotating punching accessory according to claim 2, wherein said attaching means are hooks that are attached to hanging chains that go through eyelets provided on the rotating ball bearing support plate.

4. The rotating punching accessory accordingly to claim 2, wherein said rotating means is a rotating ball bearing support plate equidistant from each end of the rectangular arm that is encircled around the hanging punching bag.

5. The rotating punching accessory according to claim 4, wherein centering tabs are provided on the inside perimeter of the rotating ball bearing support plate.

* * * * *